United States Patent [19]

Wirtgen

[11] Patent Number: 4,647,248

[45] Date of Patent: Mar. 3, 1987

[54] COMPACT MILLING MACHINE FOR MILLING OFF DAMAGED ROAD SURFACES

[76] Inventor: Reinhard Wirtgen, Hohner Strasse 2, D-5461 Windhagen, Fed. Rep. of Germany

[21] Appl. No.: 699,253

[22] Filed: Feb. 7, 1985

[30] Foreign Application Priority Data

Feb. 16, 1984 [DE] Fed. Rep. of Germany ..... 3405473

[51] Int. Cl.[4] ..... E01C 23/12

[52] U.S. Cl. ..... 404/90; 404/101; 198/511

[58] Field of Search ..... 404/90, 91, 101; 299/39; 37/95, 96; 198/511, 522

[56] References Cited

U.S. PATENT DOCUMENTS

| | | | |
|---|---|---|---|
| 1,449,075 | 3/1923 | Walker | 404/91 X |
| 2,411,210 | 11/1946 | Henderson | 37/95 |
| 2,729,002 | 1/1956 | Hedgecock | 299/39 |
| 3,843,274 | 10/1974 | Gutman et al. | 404/91 |
| 4,037,981 | 7/1977 | Wirtgen | 404/91 |
| 4,139,318 | 2/1979 | Jakob et al. | 404/90 |
| 4,186,968 | 2/1980 | Barton | 404/90 X |
| 4,193,636 | 3/1980 | Jakob | 299/39 |
| 4,325,580 | 4/1982 | Swisher, Jr. et al. | 404/90 X |

FOREIGN PATENT DOCUMENTS

| | | | |
|---|---|---|---|
| 2542504 | 4/1977 | Fed. Rep. of Germany . | |
| 2600863 | 7/1977 | Fed. Rep. of Germany | 404/91 |
| 2829125 | 1/1980 | Fed. Rep. of Germany | 404/91 |
| 7503658 | 1/1976 | Netherlands | 404/91 |
| 1261000 | 1/1972 | United Kingdom . | |
| 1406601 | 9/1975 | United Kingdom . | |
| 1506176 | 4/1978 | United Kingdom . | |
| 1540677 | 2/1979 | United Kingdom . | |
| 2154266 | 9/1985 | United Kingdom | 404/90 |

*Primary Examiner*—Stephen J. Novosad
*Assistant Examiner*—John F. Latchford
*Attorney, Agent, or Firm*—Steinberg & Raskin

[57] ABSTRACT

The invention relates to a compact milling machine for milling off damaged road surfaces, having a loading device for the milled-off material and consisting of a chassis, provided with a drive motor and having a front wheel pair which can be steered and driven, and a milling roller, which can be driven by the drive motor in the opposite direction of rotation of the chassis wheels and is attached to the end of the chassis, the milling roller having support wheels adjustably arranged on their holders, in which compact milling machine, in the direction of travel, behind the milling roller, a loading device consisting of a conveyor belt and provided with a holder is arranged in such a way that it can be swivelled about a horizontal axis preferably by means of a hydraulic positioning cylinder.

8 Claims, 4 Drawing Figures

COMPACT MILLING MACHINE FOR MILLING OFF DAMAGED ROAD SURFACES

BACKGROUND OF THE INVENTION

The invention relates to a compact milling machine for milling off damaged road surfaces.

Such milling machines are already in use in various sizes. For milling off motorways, they have a milling width of about 3.75 meters and thus enable an entire motorway lane to be milled off in a single operation. Small machines, which in particular come into use on ordinary roads and in towns, have a correspondingly narrower milling width. Such machines can be used for warm milling or also for cold milling. In the cold milling process, the road surface to be milled off is not heated prior to milling off, and consequently the wear on milling tools, which are arranged on the milling roller, is relatively large. On the other hand, preheating the road surface to be milled off virtually doubles the milling machine size because of the burners, which are to be arranged ahead of the milling machine, and the gas tank for the heating gas required for operating the burners.

Because of these relatively large sizes, warm milling machines are therefore used in particular on motorways and straight ordinary roads, whereas smaller cold milling machines come into use in particular in towns and villages.

For this purpose, and also especially for minor repair work, so called compact milling machines have been developed which work by the cold milling method and are relatively small in size. They can therefore be used without difficulty on narrow and winding roads and in villages and towns in order to carry out the requisite milling work there for repairing the damaged road surfaces.

After the milling process has been carried out, the road surface material milled off by the road milling machines normally remains on the milled-off road surface and has to be transported by means of power sweepers and special loading devices onto lorries and removed.

In this connection, since the work is relatively labour-intensive, loading devices for road milling machines have already been developed by the applicant, which loading devices are arranged at the rear of the machine and which collect the accumulating, milled-off material during the milling process and load it by means of a loading belt onto a lorry following the milling machine.

Such loading devices are known, for example, from the German Patent Specification Nos. 2,500,861, 2,600,863, 2,829,125 and 3,032,643.

However, the loading devices described in these earlier patent applications by the same applicant are only suitable for the relatively large sized road milling machines mentioned at the beginning. In connection with the recently developed compact milling machines, difficulties result insofar as these compact milling machines have a somewhat different construction.

These consist of a chassis, provided with a drive motor and having a front wheel pair which can be steered and driven, and a milling roller, which can be driven by the drive motor in the opposite direction of rotation of the chassis wheels and is attached to the end of the chassis, the milling roller having support wheels adjustably arranged on their holders. Moreover, these support wheels at the same time represent the rear wheels of the chassis, so that the milling roller is arranged virtually at the rear end of the chassis.

Although the arrangement of a loading device, as known from the abovementioned patent specifications, at the rear of the chassis is possible in principle, these loading devices do, however, obstruct access to the milling roller and consequently hinder the milling tool change, which is frequently required especially when cold milling. Previously, therefore, the new compact cold milling machines were only operated without a loading device, and the milled-off material had to be removed from the milled-off road surface by additional operations.

SUMMARY OF THE INVENTION

The object of the present invention is to provide a remedy.

The same consequently relates to a compact milling machine for milling off damaged road surfaces, having a built-on loading device for the milled-off material and consisting of a chassis, provided with a drive motor and having a front wheel pair which can be steered and driven, and a milling roller, which can be driven by the drive motor in the opposite direction of rotation of the chassis wheels and is attached to the end of the chassis, the milling roller having support wheels adjustably arranged on their holders, which compact milling machine is characterised in that, in the direction of travel, behind the milling roller, a loading device consisting of a conveyor belt and provided with a holder is arranged in such a way that it can be swivelled.

Such a loading device can be swung out of its milling position after the milling process is complete and thus provides access to the milling roller in order to replace the worn milling tools.

Moreover, it has turned out to be particularly expedient if the holder of the loading device is arranged so that it can swivel about a horizontal axis in two bearings, which are arranged above the milling roller.

By swivelling up the holder having the loading device, for example by means of a hydraulic lifting cylinder or rack jack or the like, the entire retaining mechanism of the loading device is raised and thus provides access to the milling roller.

The thrust plate arrangements, in the known loading devices, for collecting the milled-off material distributed over the entire milling width are much too voluminous for use in compact milling machines and therefore cannot be used.

Instead, it has turned out to be expedient to provide a largely vertically located equalizing plate on the holder of the loading device, which equalizing plate overlaps the area milled-off by the milling roller. This equalizing plate has an opening for the milled-off material, which is transported towards the rear by the milling roller, which acts as a conveyor roller, and collects behind the milling roller and in front of the equalizing plate.

This opening is expediently provided at the lower edge of the equalizing plate, for example at the centre of the equalizing plate, and it enables the milled-off material to emerge in a defined area, where it is then collected by the loading conveyor and transported onto the following lorry.

According to another advantageous embodiment form of the present invention, the opening for the milled-off material is located halfway up the equalizing plate so that the same falls, as it were from above, onto the loading device arranged behind and is transported further onto the lorry.

Moreover, it has turned out to be advantageous if the equalizing plate is arranged in vertical, slotted holes over the holder of the loading device and consequently can be adapted to the different milling depths without difficulty. Because the equalising plate is subjected to very high wear, it has turned out to be particularly expedient if the equalizing plate edge coming into contact with the milled-off road surface is provided with a carbide plating.

It has turned out to be very expedient if the loading device is retained in such a way that it can be vertically displaced in a vertical, slotted hole of the holding device. This makes it possible for the loading device to be automatically supported on the milled-off road surface by means of a sliding shoe, even when there are different milling depths, and consequently the milled-off material is completely taken over the loading device.

According to another advantageous embodiment form of the present invention, the loading device is connected by means of one or more snap-closure couplings to the holding device. This additionally makes it possible for the loading device to be uncoupled when required, and work to be continued only with the equalizing plate provided on the holding device. The material collected by the equalizing plate then emerges out of the opening and accumulates in this way, already in a collected form, and can easily be picked up later.

On the other hand, there is also the additional possibility, by simply raising the equalizing plate, of completely avoiding the milled-off material from collecting, so that the material accumulates in a distributed manner over the milled-off road surface.

Finally, it has turned out to be very expedient if the loading device is fixed in such a way that it can be swivelled about a vertical axis, to the holder for the loading device. Such a swivelling ability enables material picked up by the loading device and transported onto the lorry to be better distributed. The milled-off material can easily be distributed on the loading surface of the lorry from the driver's position, especially if an additional hydraulic lifting cylinder or positioning cylinder is provided for swivelling the loading device about the vertical axis.

BRIEF DESCRIPTION OF THE DRAWINGS

The compact milling machine according to the invention and having the loading device is shown in greater detail as follows with reference to the illustrative embodiments shown in the drawings, wherein.

DESCRIPTION OF THE PREFERRED EMBODIMENT

Figure 1:
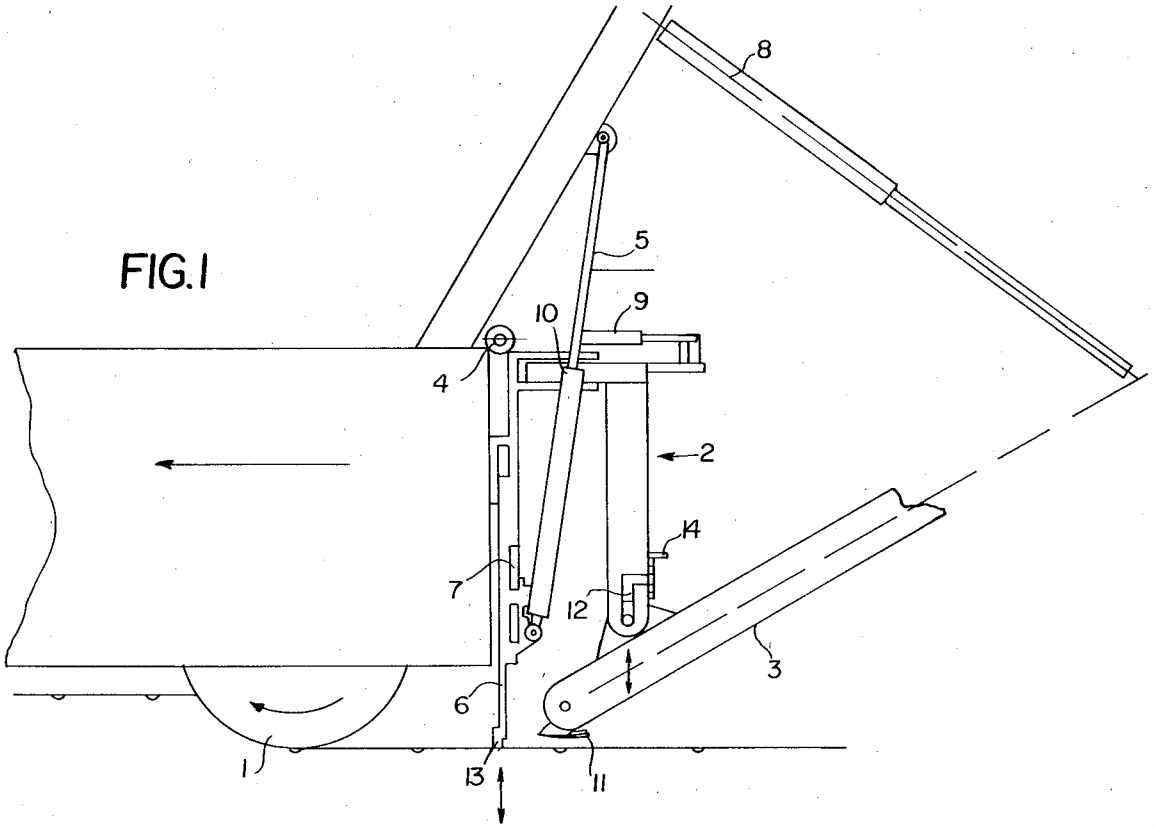
FIG. 1 shows a partial view of the compact milling machine according to the invention, with a side view of the loading device arranged at the end.

Only the rear end of the compact milling machine having the milling roller 1 is shown in the embodiment form, shown by way of example in FIG. 1, of the present invention. For the sake of clarity, the support wheels provided on each side of the milling roller 1 on the holders of the latter are not shown. They are used for the milling depth setting.

Figure 2:
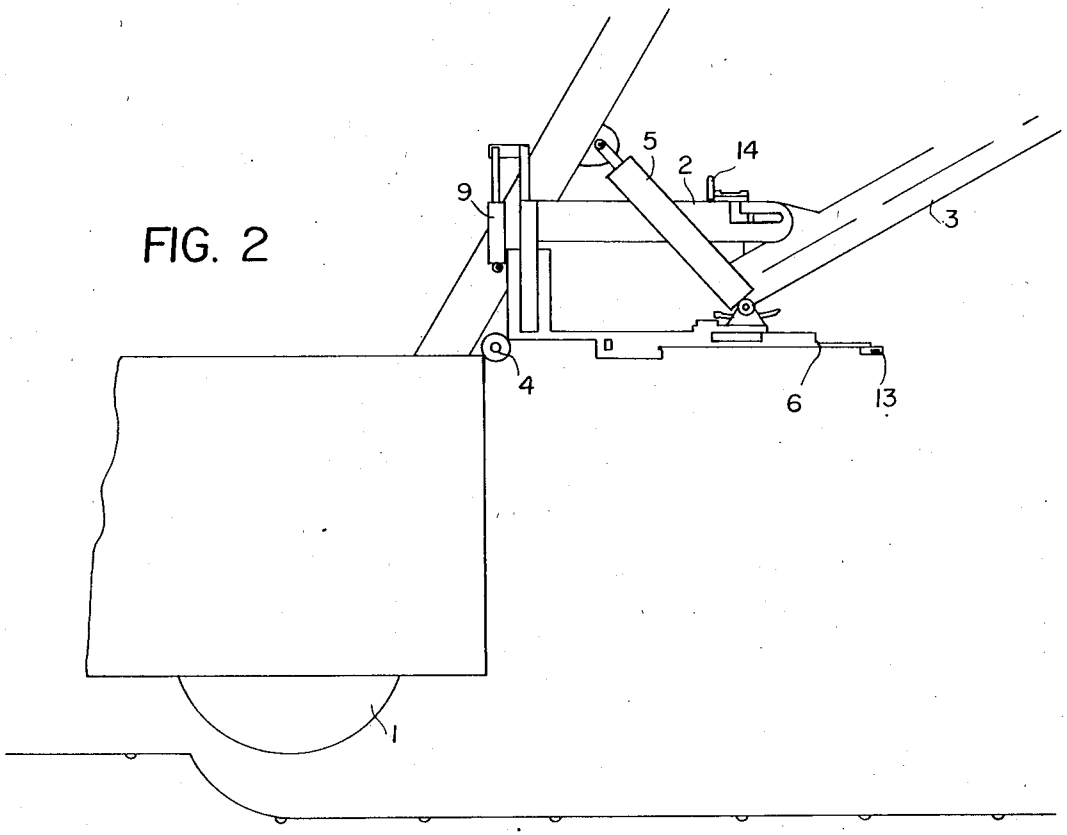
FIG. 2 shows a partial view of the milling machine according to the invention, with raised loading device.

The holder 2 for the loading device 3 is arranged at the end of the milling machine in such a way that it can swivel about horizontally arranged bearings 4. A hydraulic positioning cylinder 5 is provided for the swivelling action, by means of which position cylinder 5 the entire holder 2, together with the loading device 3, can be raised in a swivelling manner about the axis of the bearings 4. FIG. 2 shows the loading device in the raised position, in which the milling roller 1 is accessible from the rear of the machine for changing the milling tools.

The equalizing plate 6 is retained in the holder 2 for the loading device 3 in such a way that it can be vertically displaced in the slotted hole 7.

The loading device 3, which includes a conveyor belt, is retained in the holder 2 in such a way that it can be swivelled about a horizontal axis and can be varied in its inclination by means of the hydraulic positioning cylinder 8. Another hydraulic positioning cylinder 9 swivels the holder 2, which in itself is articulated, about the vertical axis 10 and thus enables the required milled-off material to be distributed on the loading surface of the lorry.

The loading belt 3, at its lower end, is provided with a sliding shoe 11, by which means it slides on the milled-off road surface. Because of the slotted hole 12 in the holder 2, the sliding shoe 11 is adapted, even when there are changes in the milling depth, to the respective, milled-off road surface.

At its lower end, the equalizing plate 6 is provided with a carbide plating 13 in order to reduce wear.

The loading belt 3 can easily be released from the holding device by releasing the hydraulic positioning cylinder 8 from the loading belt 3 and by opening the snap-closure lock 14. This opens up the possibility already mentioned above of merely collecting the milled-off material by means of the equalizing plate 6 and depositing it in a continuous heap on the milled-off road surface.

Figure 3:
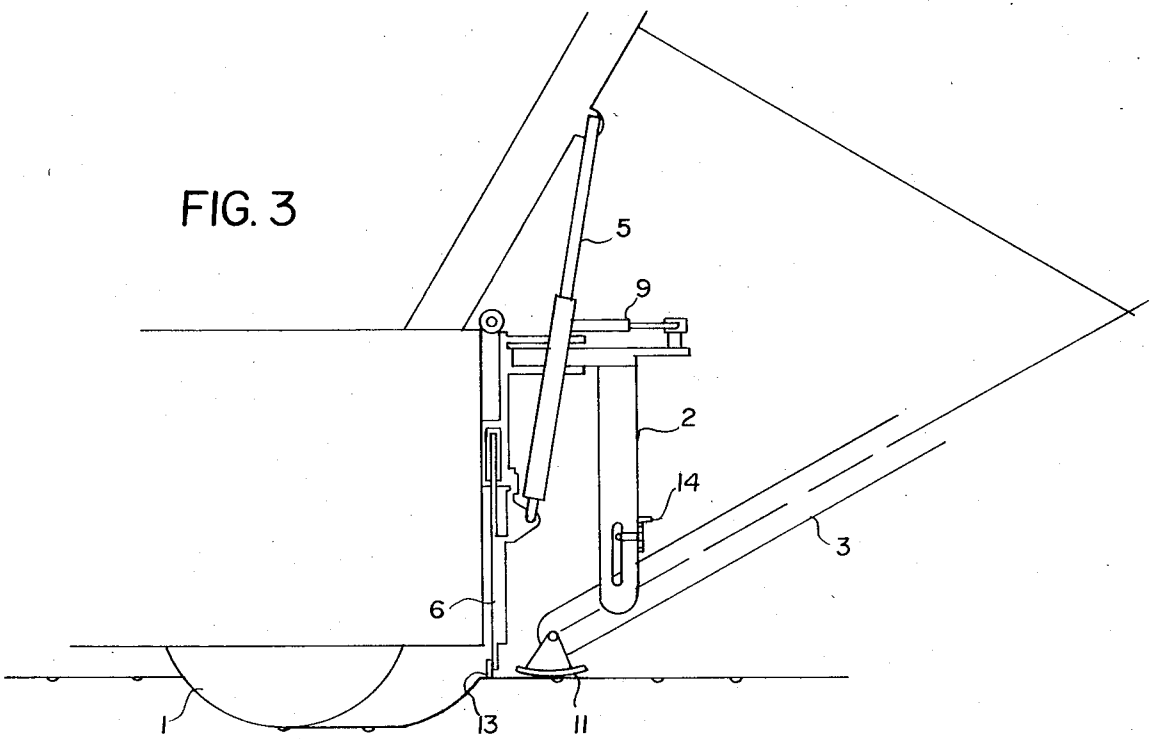
FIG. 3 shows a partial view of the milling machine according to the invention, in which milling machine the equalizing plate has just been raised.

In the embodiment form shown in FIG. 3, the position before starting to mill is shown at maximum milling depth.

Figure 4:
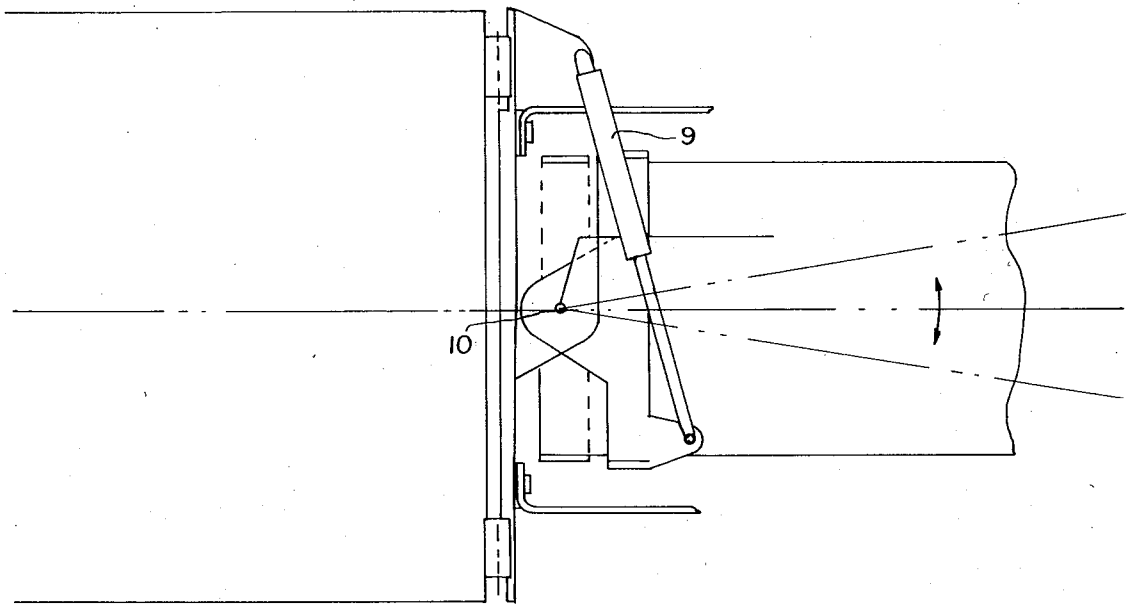
FIG. 4 shows a plan view of the rear end of the compact milling machine according to the invention and having the coupled loading device.

The lateral swivel of the loading belt by means of the hydraulic positioning cylinder 9 about the axis 10 within the holding device 2 can be seen in the plan view shown in FIG. 4.

I claim:

1. A compact milling machine for milling damaged road surfaces, comprising a chassis, a front pair of wheels mounted on said chassis, a milling roller mounted on said chassis, drive motor means for rotating said roller in a direction opposite to the direction of rotation of said front pair of wheels, a pair of bearings situated upon said chassis above said milling roller, a loading device situated behind said milling roller, said loading device including a conveyor belt and a holder coupled to said conveyor belt, said holder being mounted on said chassis in mounting means for permitting said holder to swivel on said chassis about a substantially horizontal axis, an equalizing plate coupled to said holder for movement with respect thereto, said equalizing plate being provided with opening means for directing milled material to said conveyor belt, said equalizing plate also being swivellable about said axis, and hydraulic cylinder means coupled to said equalizing plate for adjusting position of said equalizing plate with respect to said holder, and for swivelling said loading device about said axis, wherein said equalizing plate is coupled to said holder for substantially vertical displacement in a slotted hole, when in an active position.

2. The machine of claim 1, wherein said equalizing plate additionally comprises a carbide plating disposed on an end thereof.

3. The machine of claim 1, wherein said mounting means additionally permit said holder to swivel on said chassis about a substantially vertical axis.

4. The machine of claim 3, additionally comprising second hydraulic cylinder means coupled to said holder for swivelling said loading device about said substantially vertical axis.

5. The machine of claim 4, wherein said mounting means additionally permit adjustment of inclination of said conveyor belt.

6. The machine of claim 5, additionally comprising third hydraulic cylinder means coupled to said conveyor belt for adjusting the inclination of the same.

7. A compact milling machine for milling damaged road surfaces, comprising a chassis, a front pair of wheels mounted on said chassis, a milling roller mounted on said chassis, drive motor means for rotating said roller in a direction opposite to the direction of rotation of said front pair of wheels, a pair of bearings situated upon said chassis above said milling roller, a loading device situated behind said milling roller, said loading device including a conveyor belt and a holder coupled to said conveyor belt, said holder being mounted on said chassis in mounting means for permitting said holder to swivel on said chassis about a substantially horizontal axis, an equalizing plate coupled to said holder for movement with respect thereto, said equalizing plate being provided with opening means for directing milled material to said conveyor belt, said equalizing plate also being swivellable about said axis, and hydraulic cylinder means coupled to said equalizing plate for adjusting position of said equalizing plate with respect to said holder, and for swivelling said loading device about said axis, additionally comprising coupling means for coupling said conveyor belt and holder, said coupling means comprising a slotted hole in said holder, and retaining means for adjustably retaining said conveyor belt to be displaceable in said slotted hole.

8. The machine of claim 7, wherein said coupling means additionally comprise at least one snap-closure coupling.

* * * * *